United States Patent [19]

Krueger

[11] 4,444,025

[45] Apr. 24, 1984

[54] CARRIER MECHANISM FOR WEFT INSERTION

[75] Inventor: Ronald G. Krueger, Statesville, N.C.

[73] Assignee: Proform, Inc., Minneapolis, Minn.

[21] Appl. No.: 377,211

[22] Filed: May 11, 1982

[51] Int. Cl.[3] ..... D04B 23/06

[52] U.S. Cl. ..... 66/84 A

[58] Field of Search ..... 66/84 A, 85 A, 125 R

[56] References Cited

U.S. PATENT DOCUMENTS

| | | | |
|---|---|---|---|
| 3,756,043 | 9/1973 | Kemter | 66/84 A |
| 3,824,811 | 7/1974 | Heilmann et al. | 66/84 A |
| 3,906,748 | 9/1975 | Heilmann et al. | 66/84 A |
| 4,123,920 | 11/1978 | Bassist | 66/84 A |
| 4,372,132 | 2/1983 | Bassist | 66/84 A |

*Primary Examiner*—Ronald Feldbaum

*Attorney, Agent, or Firm*—Oblon, Fisher, Spivak, McClelland & Maier

[57] ABSTRACT

A carrier mechanism for the insertion of weft fibers is provided, consisting of only one moving part. The mechanism comprises a frame with guide holes through which the weft fibers may be led and a presser bar apparatus mounted on the frame in a fashion to allow free rotation of the presser bar apparatus. The presser bar apparatus is slidably engaged with a carrier cam mechanism mounted upon a loom or knitting machine wherein the weft fibers are incorporated into a fabric. By providing this slidable engagement off-center of the presser bar apparatus, one or the other presser bar may be caused to be depressed by translational movement of the carrier mechanism. At the point of greatest depression of each presser bar, the weft fibers are depressed to the extent that they are engaged by belts of hooks at either end of the loom, which hooks then advance the weft fibers, maintained in parallel alignment, into the loom or knitting machine. The carrier mechanism, preferably constructed of aluminum, allows for high-speed fabric production, with minimal imperfections due to strain on the weft fibers caused by the carrier and eliminates strain placed on the loom itself and associated drive mechanisms.

5 Claims, 5 Drawing Figures

CARRIER MECHANISM FOR WEFT INSERTION

FIELD OF THE INVENTION

The invention disclosed and claimed herein is a carrier mechanism for use in conjunction with a fabric knitting or sewing machine or weaving loom, whereby weft fibers or threads, i.e., those running in a direction perpendicular to the warp or longitudinal axis of the fabric, from selvage to selvage, may be provided. Specifically, the invention allows the weft fibers to be provided in an appropriate array, which may then be advanced into the knitting machine, to be united with warp fibers and/or other layers of the fabric. In particular, the instant invention is suitable for use in connection with structural fibers and fabrics, although it is susceptible of many other applications.

DESCRIPTION OF THE PRIOR ART

In the textile industry in general, and in particular, the structural fabric industry, one common method for manufacturing fabrics with fibers running in at least two directions, warp and weft, is by use of a knitting or sewing machine, or weaving loom, whereby the fibers running in each direction are united into a single fabric, either by knitting or sewing therebetween yet a third fiber, or by interweaving of the two fibers. The warp fibers, generally running parallel to the longitudinal axis, may in most instances be led directly into the machine or loom in parallel alignment, already parallel to the axis to be established. However, the weft fibers must be introduced into the machine or loom in an array such that the weft fibers are at right angles to those warp fibers. To minimize the complexity of the loom or machine, the weft fibers are generally advanced into the loom by means of an endless belt of hooks running parallel to each other at either end of the loom, which advance the fibers into the loom, where they are united with the warp fibers.

The fibers are brought into contact with the hooks so that they may thereby be engaged and advanced by means of a carrier mechanism which shuttles back and forth between the two hook belts at a high rate of speed. When the carrier mechanism arrives at one of the hook belts, a presser bar is depressed, thereby depressing the fibers which are led from a source through the carrier mechanism itself and on to the hooks, in such a fashion that the advancing hooks catch the fiber. Once the fibers are engaged and advanced, the presser bar is lifted and the carrier mechanism shuttles to the other side, where the operation is repeated.

The depression of the presser bars in the prior art carrier mechanisms is accomplished by a complicated series of gearing mechanisms that require a large number of moving parts. This gearing mechanism is in turn actuated by the impact of the carrier mechanism against the end wall of the loom. As a result, the action of the presser bars themselves is abrupt and severe, placing extreme strains on the weft fibers. These strains result in breakage and deformities which affect the overall integrity and value of the resultant product.

Similarly, the action of the gearing mechanism, as well as the attendant weight factor, places great demands on the loom itself, as well as the related cams, gearing and chain and belt drives that are required to move the carrier. The weight of the carrier mechanism of the prior art approaches 21 pounds. Because of this weight, the speed of translational movement of the carrier mechanism from one end of the loom to the other is limited, in general, to an R.P.M. of 450. These same factors also limit the yarn size to about 10,000 denier (450 yd/lb).

A further difficulty encountered in using the prior art carrier mechanisms is the extremely short useful life of the gearing system employed to depress the presser bars. Because of the repeated, severe strains placed on these gears, they tend to wear out quite frequently. The average useful life of the prior art carrier mechanisms is no more than six months. The frequent replacement thereby required results not only in added expense, but substantial "downtime" of the loom, further sacrificing economic efficiency.

SUMMARY OF THE INVENTION

In order to overcome the above-described difficulties of the prior art, the Applicant has developed an improved carrier mechanism which involves only one moving part, and which effects depression of the presser bars to thereby engage the weft fibers with the advancing hooks of the loom machine in a constant, gentle fashion, that avoids placing stress on the carrier mechanism, the loom itself, and the weft fibers.

The carrier mechanism is comprised of a frame which may be of any suitable shape and dimension, but is desirably rectangular, and is provided with aligned guide holes in the top and bottom portions of the frame, through which the weft fibers may be vertically led from a source and, from the bottom of the loom, to a point where they may be engaged, through the action of the presser bars, by the advancing hooks of the loom.

The sole moving part of the carrier mechanism is the presser bar apparatus attached thereto. This presser bar apparatus is mounted upon the frame in such fashion that it is capable of rotational movement about a central pivot point, which is desirably aligned with the axis of the carrier frame. The presser bar apparatus consists of two rigid presser bars, which are located on either side of the frame, and connected to each other by a rigid connecting portion. Generally, the presser bar apparatus is mounted upon the frame at the center of the connection portion, by means susceptible of providing freedom for rotational movement, such as an axle and ball-bearing arrangement. When mounted in such a fashion, the presser bars are capable of rotation through an arc extending from a point beneath the frame and sufficiently below the frame so as to depress the fibers to the extent that they may be engaged by the advancing hooks upwards.

The alternate depression of first and second presser bars is effected by means of a carrier cam affixed to and extending across the width of the machine or loom wherein the fabric is to be produced. This cam extends horizontally, but at a slight angle to the horizontal level, and is slidably engaged by a protrusion provided on the presser bar apparatus, preferably on the connecting portion, but off-center thereof. As the carrier mechanism frame is moved from one end of the loom to the other by means of a conventional belt drive attached to a means capable of reversing the belt, such as a reversing cam means, the presser bar nearest to the protrusion slidably engaging the carrier cam is lowered or raised, according to the angle of the cam. When the carrier mechanism is at the end of the loom where the carrier cam is at its lowest point, the presser bar on the side of the presser bar apparatus where the protrusion is affixed is depressed to a point beneath and below the carrier frame, to a sufficient degree such that the fibers are thereby depressed and engaged by the hooks. As the carrier mechanism reverses and moves to the other side of the loom, the presser bar apparatus undergoes a slow, gentle rotation, due to the raising of the previously depressed presser bar caused by the inclination of the cam, and corresponding lowering of the opposite presser bar, to the extent that, when reaching the opposite side of the loom, the opposite presser bar is depressed to the corresponding point necessary to cause the fibers to be engaged by the advancing hooks.

By virtue of the gentle rotational movement of the presser bars, there are no severe strains placed on the fibers themselves. Similarly, by dispensing with the gearing mechanism of the prior art, useful life expectancy is substantially increased, while decreasing downtime. Additionally, the limitations of the prior art carrier mechanisms with regard to speed and yarn dimension are removed, due to the lower weight of the instant invention. In a preferred embodiment, the above-described carrier weighs only six pounds, an advantage of more than 300 percent over that of the prior art.

Accordingly, it is an object of this invention to provide a carrier mechanism which efficiently allows for the insertion of weft fibers without placing strain upon or causing breakage of those fibers.

Another object of this invention is a carrier mechanism which, due to its light weight, is capable of extremely high speed, and is not limited to the weight of yarn employed.

Yet a third object of this invention is to provide a carrier mechanism which, due to the reduction in the number of moving parts, enjoys a superior useful life expectancy, and substantially reduces the down-time experienced.

Still another object of this invention is to provide a carrier mechanism which, due to its gentle operation, avoids placing strain upon the associated drive means, thereby reducing the requirements of these drive means.

This invention, and its embodiments, can be better understood with reference to the attached drawings, and their description, below.

DETAILED DESCRIPTION OF THE INVENTION

Figure 1:
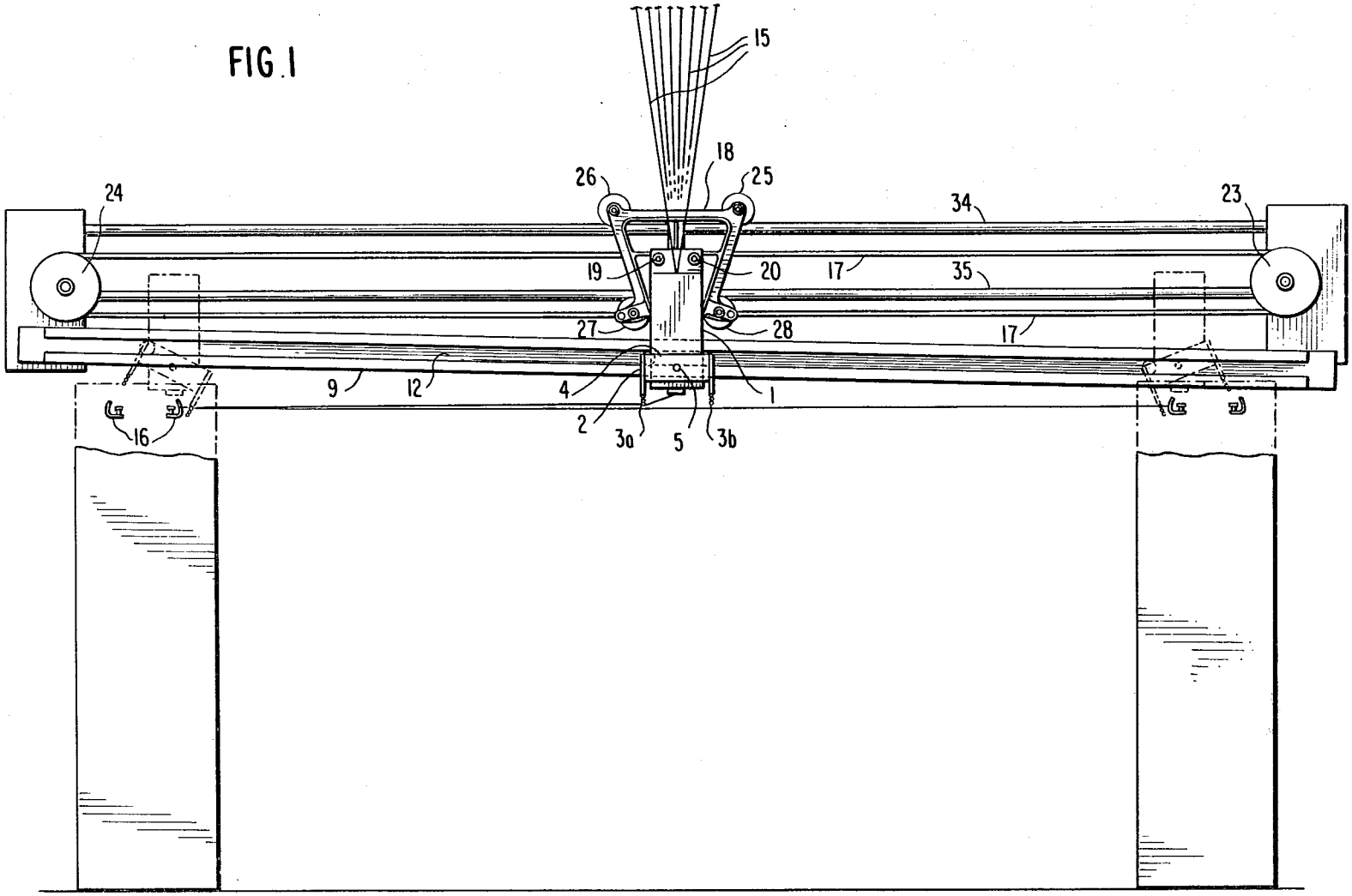
FIG. 1 is a front view of the carrier mechanism illustrating the mechanism at midpoint on the loom, with positions at either end of the loom illustrated by phantom lines.

Referring now to the drawings described above, the carrier mechanism is comprised of a rigid frame 1. Mounted upon this frame is a presser bar apparatus 2, which consists of two presser bars *3a* and *3b* and a U-shaped rigid connecting portion 4. The presser bar apparatus is mounted upon the frame at pivot point 5, which mount allows the presser bar apparatus to freely rotate thereabout.

Figure 3:
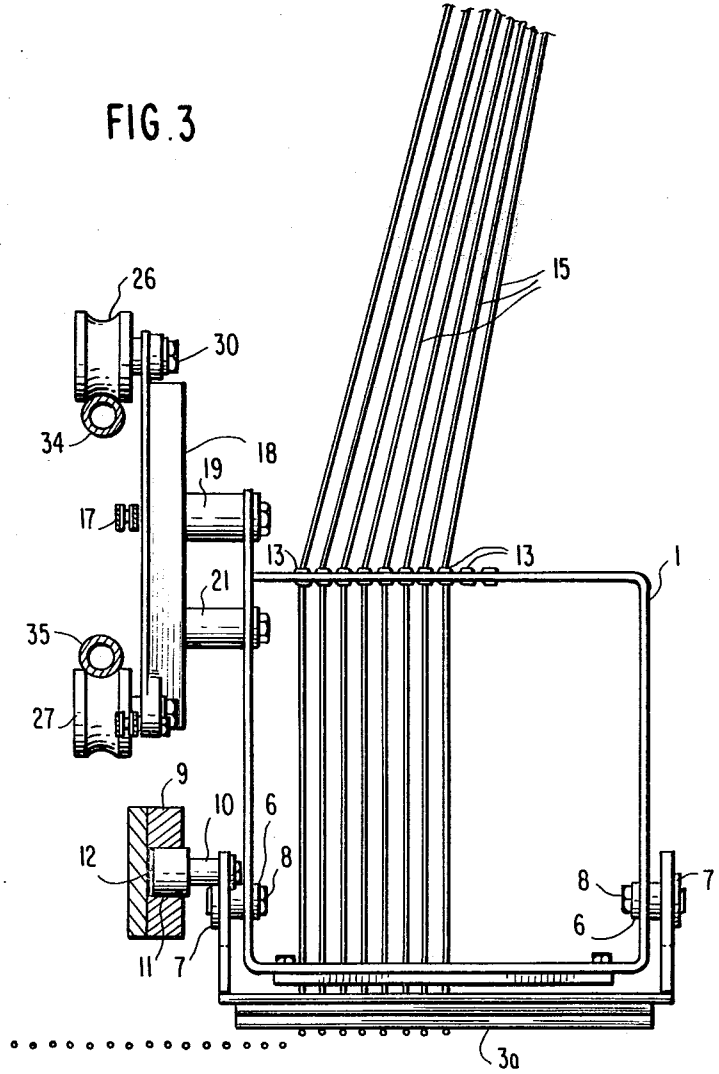
FIG. 3 is a side view of the carrier mechanism and weft fiber.

As illustrated in FIG. 3, in particular, this mount can, in a preferred embodiment, consist of an axle 6 which protrudes through the connecting portion of the presser bar apparatus 4. The presser bar apparatus is secured thereon by a nut 7 or similar device. Axle 6 may also be secured by use of a bolt 8. Although this mounting is illustrated as existing at either end of the carrier mechanism frame 1, if a single mounting of sufficient strength to hold the presser bar apparatus in rigid relation to the frame is provided, a single mount may be sufficient.

The presser bar apparatus is slidably engaged with carrier cam 9 by protrusion 10. Although this engagement may be effected by any means, in a preferred embodiment, as illustrated in the drawings, engagement is achieved by use of roller 11 which slides or rolls in corresponding groove 12 of the carrier cam.

Figure 5:
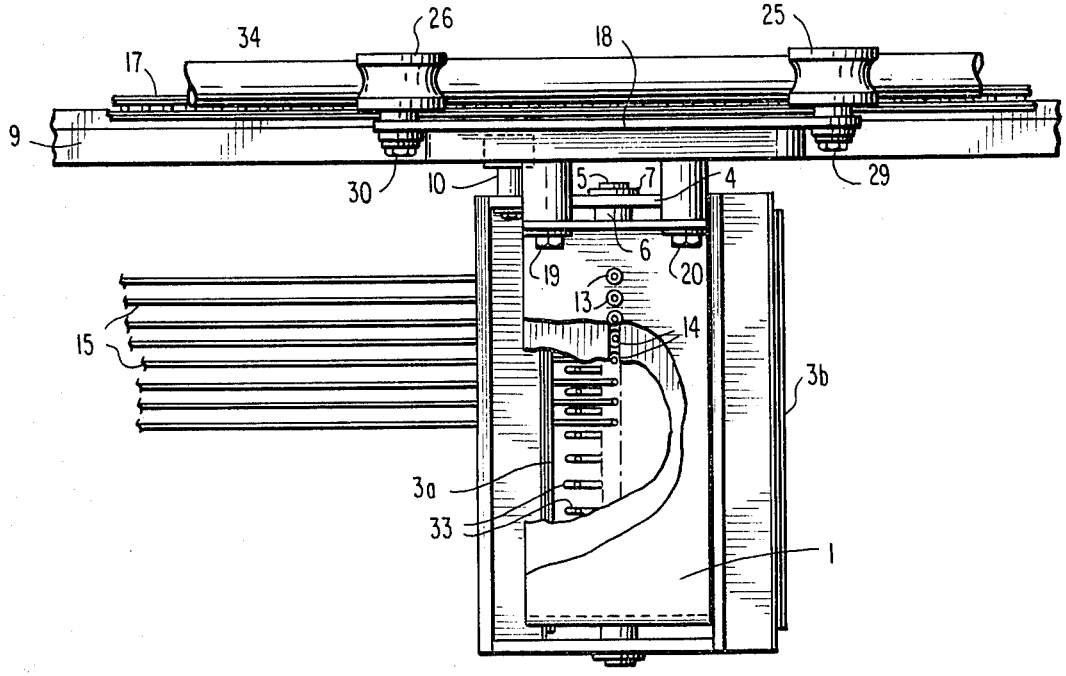
FIG. 5 is a transverse view through the carrier mechanism illustrating, by cutaway, weft fiber positioning.

In the frame 1 of the carrier mechanism, two sets of a plurality of aligned guide holes, upper set 13 and corresponding lower set 14 illustrated in FIGS. 3 and 5, respectively, are provided. Through these guide holes, weft fibers 15 may be led from a source (not illustrated) through the carrier mechanism and out below the frame, so as to be depressed by the presser bars of the presser bar apparatus. At either end of the loom upon which the carrier cam 9 is mounted are endless belts of hooks 16. These hook belts are driven in coordination with the motion of the carrier mechanism, such that while the carrier mechanism is positioned over one set of hooks, and before translational motion of the carrier mechanism across the loom can begin, the hooks are advanced such that each hook is engaged by a single fiber, and there is no overlapping of fibers in the fabric. The speed of the carrier mechanism is such that it arrives at the opposite belt of hooks in time to effect engagement of a fiber with the hook adjacent the last hook previously engaged by a fiber. Of course, the initial engagement of the fibers by the hooks may be done manually.

Translational movement of the carrier mechanism is effected by means of a belt or chain 17 affixed to superstructure 18. Superstructure 18 is, in turn, affixed to frame 1 by bolts 19–22. Belt 17 is looped around pulleys 23 and 24 to allow for easy reversal of direction of motion.

The belts may be driven by a driving means capable of reversing direction, including such as a reversing cam means. Many alternative driving means (not illustrated) will occur to one of ordinary skill in the art, and the invention is not thereby limited.

In order to provide smoothness of running and reduce friction as far as possible, superstructure 18 may run on upper and lower rods 34 and 35, respectively, on wheels 25–28, affixed to the superstructure by bolts 29–32.

Although the frame, presser bar apparatus and superstructure may each be comprised of any material rigid enough to meet the demands placed thereon, in a preferred embodiment, the carrier mechanism is made of aluminum, of similar lightweight metal, so as to decrease weight as much as possible. When made of aluminum, the entire carrier mechanism weighs about 6 pounds.

Figure 4:
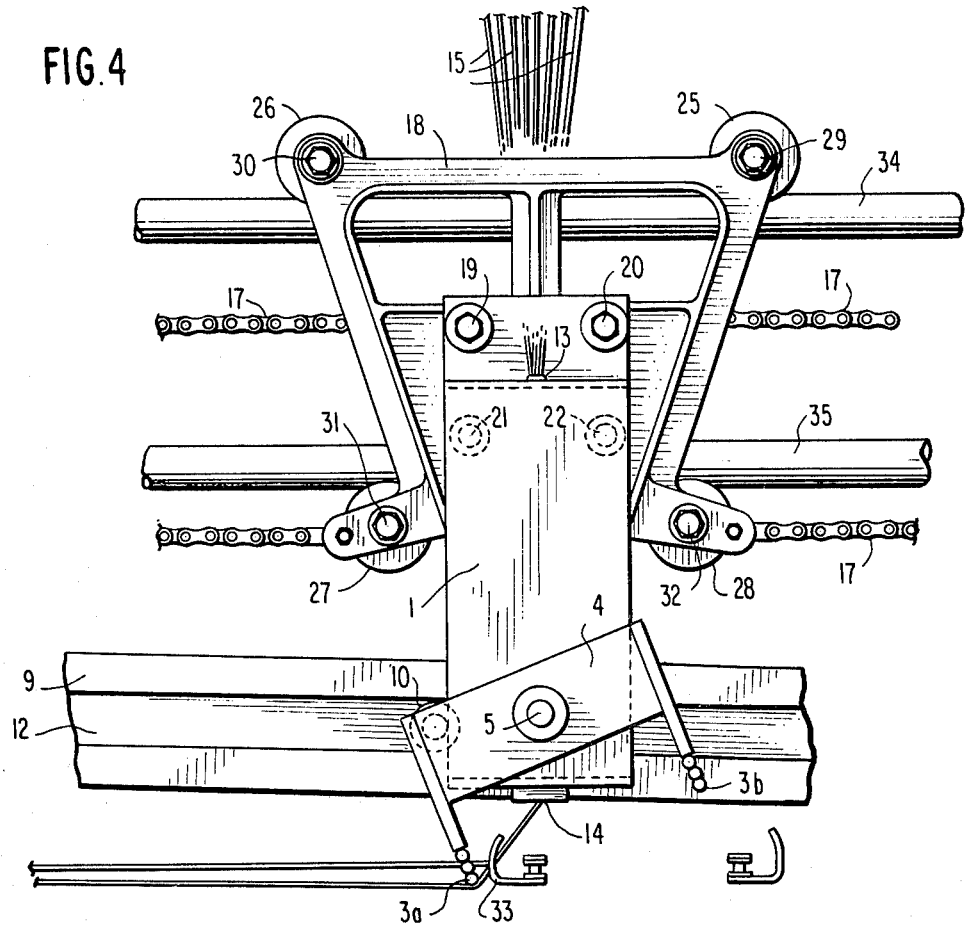
FIG. 4 is a front view of the carrier mechanism at an end position, particularly illustrating the depression of the weft fiber and engagement thereof by the advancing hook belt.

The engagement of the weft fibers by the advancing hooks, whereby a series of parallel fibers running perpendicular to the warp of the fabric to be constructed is provided, is best illustrated in FIG. 4. As shown therein, when at one end of the carrier cam, presser bar 3*a* is depressed, through rotational motion, to a point beneath and below the carrier frame, to a sufficient extent to allow the fiber 15 thereby depressed to be engaged by the advancing hook 33 which is part of hook belt 16. As the hook moves forward, the fiber 15 is looped around it, so that when the carrier mechanism is caused to move across the loom, fiber 15 runs across the width of the loom, perpendicular to the direction of warp fibers or threads.

Figure 2:
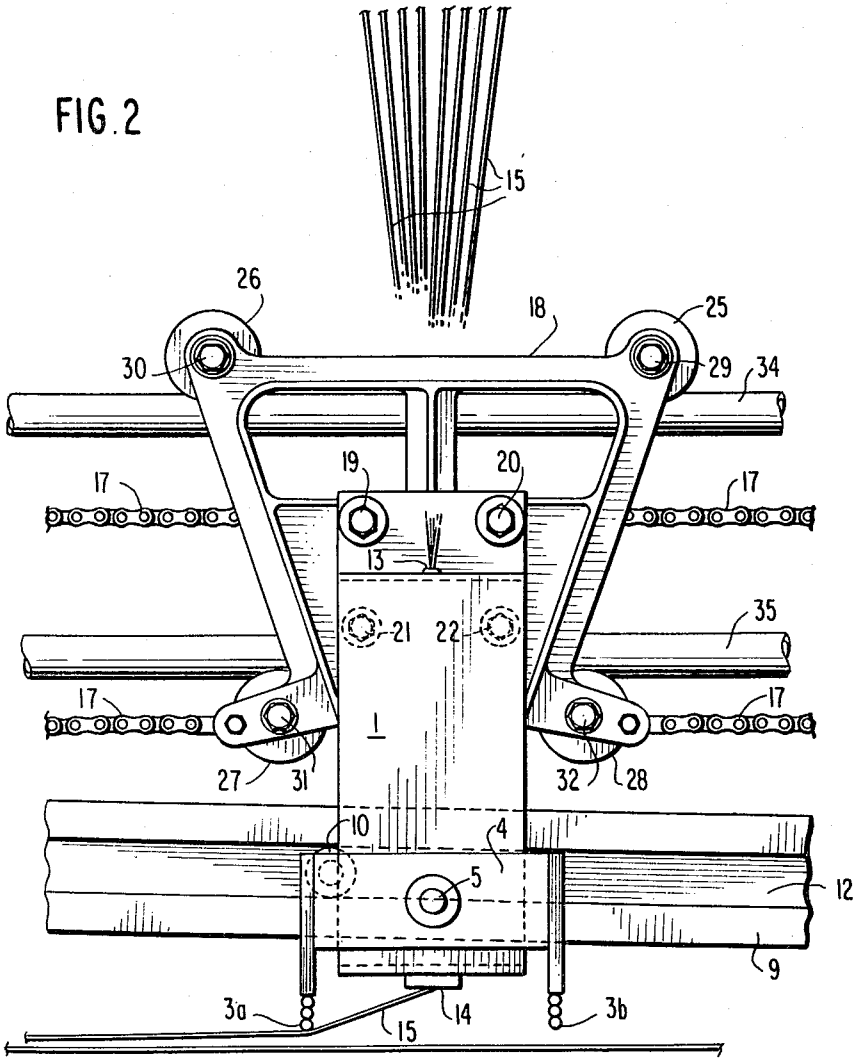
FIG. 2 is a front view of the carrier mechanism itself, particularly illustrating the drive means employed to achieve translational motion.

Due to the off-center location of protrusion 10, as the carrier mechanism moves from its position in FIG. 4 across the loom to the position in FIGS. 1 and 2, the presser bar apparatus rotates, such that presser bars 3*a* and 3*b* are at identical heights, at a point corresponding to the midpoint of the width of the loom. As the translational motion of the carrier mechanism continues, and it is pulled further towards the end of the loom not pictured in FIG. 4, the presser bar apparatus further rotates about point 5 due to the incline of carrier cam 9, which causes protrusion 10 to elevate due to their engagement. As a result, presser bar 3*a* is lifted, and presser bar 3*b* is correspondingly lowered or depressed, such that the fibers 15 are thereby depressed, and engaged by hooks corresponding to hook 33 on the opposite side of the loom.

As is apparent, in contrast to the jerky and abrupt operation of the prior art carrier mechanism described above, the presser bars of this invention are depressed through a gradual, gentle movement through the slight incline of the carrier cam. Accordingly, no severe strains are placed upon fibers 15. Additionally, the strains placed upon the drive mechanism and supporting structures, as well as the loom itself, by the action of the gear mechanisms of the prior art carrier mechanism is completely done away with. Further, as the rotation of the presser bar apparatus requires no gearing or meshing of parts, and involves in fact only a single moving part, the presser bar apparatus itself, useful life of the carrier mechanism is greatly extended and repairs or replacements of the carrier mechanism of this invention are not envisioned as being often necessary.

As will occur to one of ordinary skill in the art, the presser bars themselves may be of any configuration, so long as they are sufficiently long to depress the number of fibers being led through the carrier mechanism frame, i.e., the presser bars should be as long as the frame itself, if not longer. Although illustrated as being comprised of a series of rods or cylinders, the presser bars may similarly conveniently be a single rod or length, so long as it is sufficiently rigid to depress the fibers.

As explained above, because of the numerous advantages of the carrier mechanism disclosed and claimed herein over that employed in the prior art, the knitting, sewing or weaving operation of producing a fabric from warp and weft fibers is made substantially trouble free, defects in the fabric itself are avoided, and the entire operation is accelerated. This is particularly true when the carrier mechanism is made of aluminum, and the fibers employed, at least the weft fibers employed, are of fiberglass or similar material. Under these conditions, movement of the carrier mechanism at speeds of up to about 700 R.P.M. have been achieved, while 99 percent of the defects occurring in the fabric due to the action of the carrier mechanism have been eliminated. Further, due to the gentleness of the operation of the carrier mechanism and the presser bar apparatus in particular, the above-described restrictions with regard to fiber dimension and denier need no longer be observed. In fact, in operation, there is practically no limit to the yarn size that may be employed.

Although the carrier mechanism of this invention has been described with particularly, it will be understood that the description provided is for illustration, and that the invention as claimed below contemplates all equivalents within the practice of this carrier mechanism. Specifically, the nature, type and quality of the materials employed in the carrier mechanism, as well as the particular configuration and methods of part interaction may vary according to the understanding and needs of those of ordinary skill in the art.

What is claimed is:

1. A carrier mechanism for weft insertion, comprising:

a frame provided with upper and lower sets of aligned guide holes through which weft fibers may be led from a source of such fibers, a presser bar apparatus comprising first and second presser bars and a rigid connecting portion therebetween and affixed thereto, said presser bar apparatus being rotatably mounted upon said frame in a fashion such that said presser bars are capable of movement through an arc, the lowest point of said arc being beneath and below said frame, said presser bar apparatus further bearing a protrusion located off-center of said connecting portion which may be slidably engaged with a carrier cam horizontally mounted upon and extending entirely across the width of a knitting machine wherein said weft fibers will be incorporated in a fabric, said carrier cam being mounted at a slight angle to the horizontal level, such that when said carrier mechanism is positioned at one end of the cam, the first presser bar is depressed to a position below and beneath said frame, thereby depressing fibers led through said frame, and when said carrier mechanism is positioned at the opposite end of said cam said second bar is depressed to a position below and beneath said frame thereby depressing fibers led through said frame, whereby, when said carrier mechanism frame is moved from one end of said cam to the other, the presser bar apparatus is caused to undergo rotational movement, which rotational movement is continuous throughout said carrier mechanism frame movement.

2. The carrier mechanism of claim 1, wherein said carrier mechanism is constructed substantially of aluminum.

3. The carrier mechanism of claim 1 or 2, wherein said frame is further rigidly connected to a superstructure, which superstructure is attached to a belt driven by means capable of reversing the direction in which said belt is driven, such that said frame may be driven in rapid translational movement along the length of said carrier cam.

4. The carrier mechanism of claim 3, wherein said driving means comprises a reversing cam mechanism.

5. The carrier mechanism of claim 1 or 2, wherein said carrier mechanism weighs about six pounds.

* * * * *